US008011952B1

(12) United States Patent
Zhong et al.

(10) Patent No.: US 8,011,952 B1
(45) Date of Patent: Sep. 6, 2011

(54) CONNECTOR ASSEMBLY WITH CARD READER

(75) Inventors: Yan Zhong, Shenzhen (CN); Jun-Jie Zheng, Shenzhen (CN); Xin Ji, Shenzhen (CN); Wen-Hsiang Hung, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/872,147

(22) Filed: Aug. 31, 2010

(30) Foreign Application Priority Data

Mar. 26, 2010 (CN) ..... 2010 1 0133523

(51) Int. Cl.
*H01R 13/60* (2006.01)

(52) U.S. Cl. ..... 439/540.1

(58) Field of Classification Search ..... 439/540.1, 439/571, 638–639, 679.43, 352; 361/363, 361/727, 686, 732
See application file for complete search history.

(56) References Cited

U.S. PATENT DOCUMENTS

| | | | | |
|---|---|---|---|---|
| 5,397,248 | A * | 3/1995 | Whiteman et al. | 439/571 |
| 5,504,648 | A * | 4/1996 | Honda et al. | 361/679.43 |
| 6,558,201 | B1 * | 5/2003 | Begley et al. | 439/638 |
| 7,316,586 | B2 * | 1/2008 | Anderson et al. | 439/638 |

* cited by examiner

*Primary Examiner* — Jean Duverne
(74) *Attorney, Agent, or Firm* — Altis Law Group, Inc.

(57) ABSTRACT

A connector assembly includes a connector, a card reader, and a housing. The housing includes a top cover and a bottom cover. The top cover includes a first receiving portion for the connector and a second receiving portion for the card reader. The top cover includes a baseboard fixed on the first receiving portion and a shutter moveably positioned on the second receiving portion covering the card reader.

17 Claims, 4 Drawing Sheets

CONNECTOR ASSEMBLY WITH CARD READER

BACKGROUND

1. Technical Field

The present disclosure relates to connector assembly and, particularly, to a connector assembly with card reader.

2. Description of the Related Art

A commonly used connector assembly includes a connector, a card reader and a housing. The connector and the card reader are undetachably fixed in the housing. However, the card reader is easily damaged by frequent card insertion, and the entire connector assembly must be replaced, thus the utility cost is increased.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views, and both the views are schematic.

DETAILED DESCRIPTION

Figure 1:
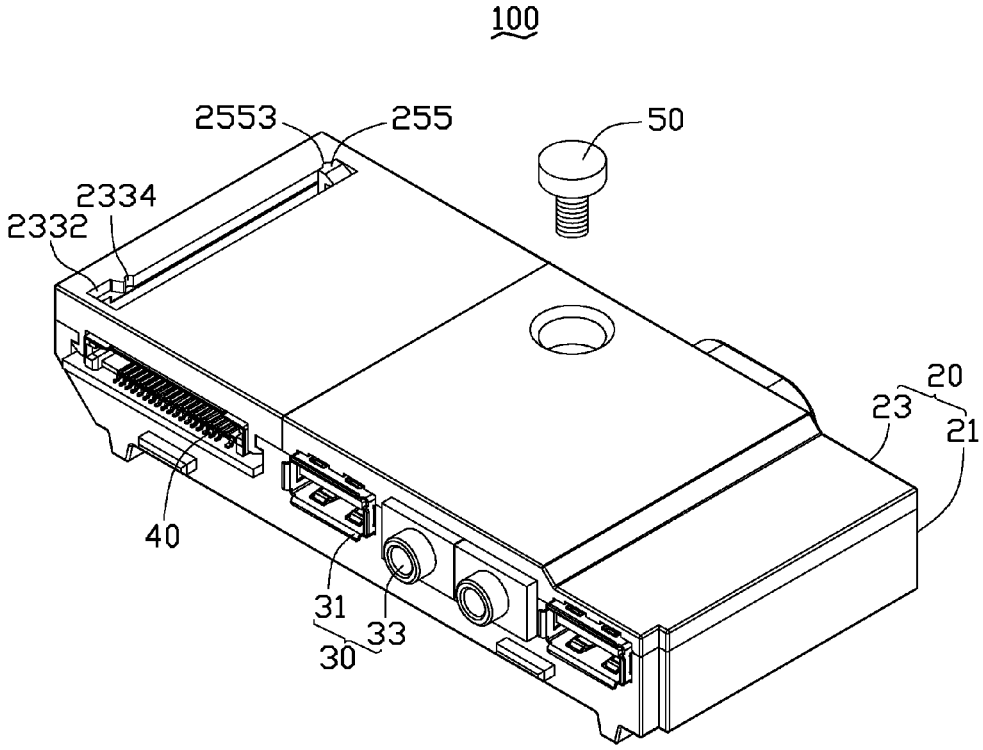
FIG. 1 is an isometric view of an embodiment of a connector assembly in a closed state.

Referring to FIG. 1, an embodiment of a connector assembly 100 may be used in an electronic device (not shown). The connector assembly 100 includes a housing 20, a connector 30, and a card reader 40. The connector 30 and the card reader 40 are positioned in the housing 20.

Figure 2:
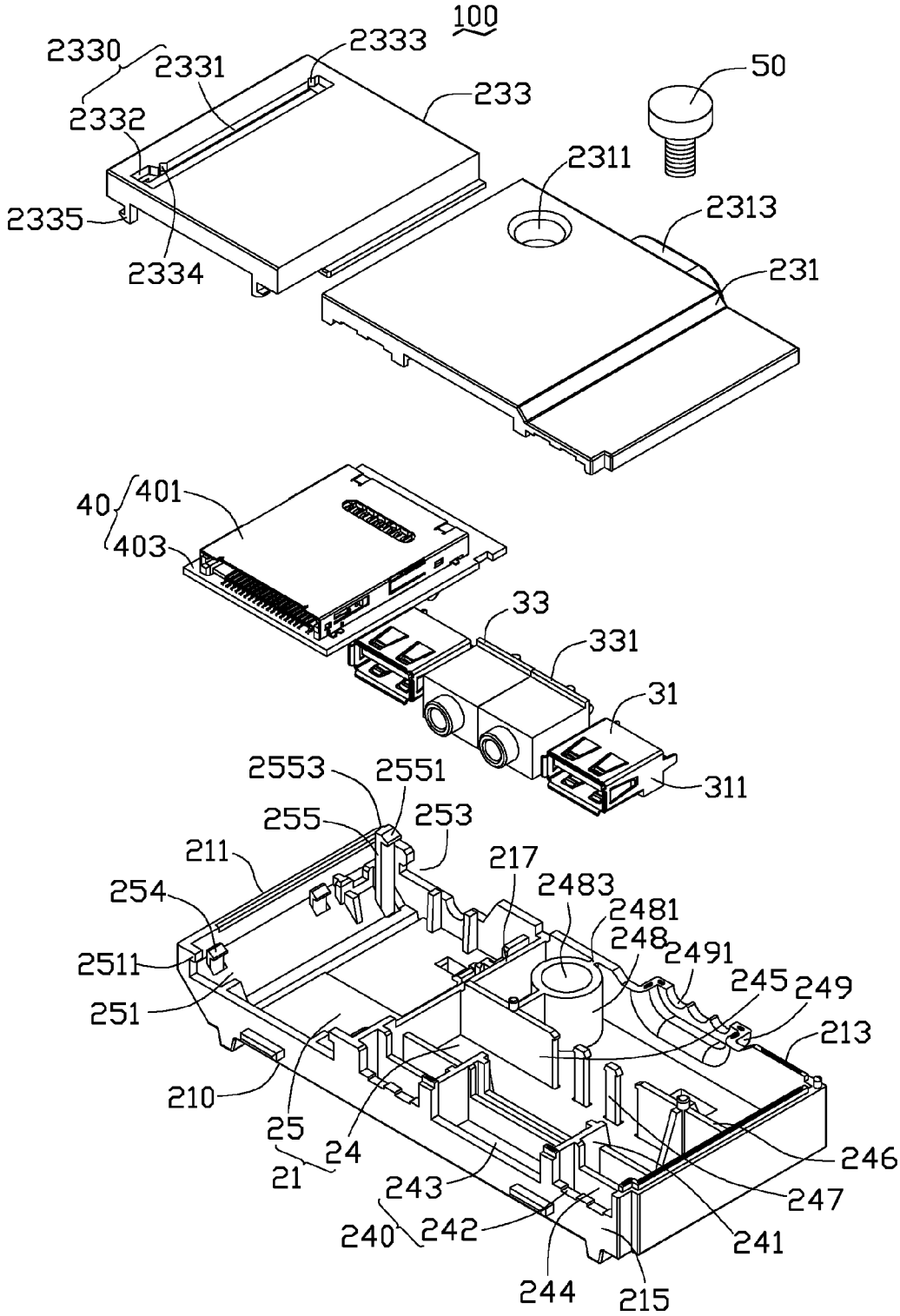
FIG. 2 is an exploded, isometric view of the connector assembly of FIG. 1.

As shown in FIG. 2, the housing 20 includes a top cover 21 and a bottom cover 23. In the illustrated embodiment, the connector 30 includes two universal serial bus (USB) jacks 31 and two audio jacks 33. Each USB jack 31 forms a positioning strip 311 thereon. Each audio jack 33 forms a stopping rib 331 thereon. Alternatively, the connector 30 may further include a video jack or only a USB jack. The card reader 40 includes a circuit board 403 and a main body 401 mounted on the circuit board 403. A size of the circuit board 403 exceeds that of the main body 401 such that when the main body 401 is mounted on the circuit board 403, an edge of the circuit board 403 protrudes out of the main body 401.

The bottom cover 21 includes a rectangular bottom surface 210, two sidewalls 211, a wiring wall 213, and a mounting wall 215. Two sidewalls 211 are formed at two opposite edges of the bottom surface 210. The wiring wall 213 and the mounting wall 215 are formed at the other edges of the bottom surface 210. Each sidewall 211 interconnects the wiring wall 213 and the mounting wall 215. The bottom surface 210, two sidewalls 211, the wiring wall 213 and the mounting wall 215 cooperatively define a cavity (not labeled) for receiving the connector 30 and the card reader 40. The bottom cover 21 forms a divider 217 between the two sidewalls 211. The divider 217 is a board interconnecting the wiring wall 213 and the mounting wall 215, and divides the bottom cover 21 into a first receiving portion 24 and a second receiving portion 25.

The first receiving portion 24 defines a receiving hole 240 at the mounting wall 215, and forms two dividing boards 241 between the divider 217 and the sidewall 211. The dividing board 241 and adjacent sidewall 211, and the dividing board 241 and divider 217 each define a USB notch 242. The two dividing boards 241 are spaced from each other and define an audio notch 243 therebetween. The bottom surface 210 forms two stopping boards 244 in both the USB notch 242 and the audio notch 243 for clamping the positioning strip 311 of the USB jack 31 and stopping rib 331 of the audio jack 33 respectively. The bottom surface 210 forms a first reinforcement board 245 and a second reinforcement board 246 spaced from the first reinforcement board 245. The bottom surface 210 forms two posts 247 between the first reinforcement board 245 and the second reinforcement board 246 through which cables can pass. The bottom surface 210 forms a fixing post 248 between the first reinforcement board 245 and the wiring board 213 and two reinforcement ribs 2481. A reinforcement rib 2481 interconnects a side of the fixing post 248 and the first reinforcement board 245, and the other reinforcement rib 2481 interconnects the fixing post 248 and the first reinforcement board 245, to firmly fix the fixing post 248 in the first receiving portion 24. The fixing post 248 defines a fixing hole 2483 therein for fixing the top cover 23 on the bottom cover 21. The receiving portion 24 forms a wiring portion 249 protruding from the wiring wall 213. The wiring portion 249 defines a plurality of wiring ports 2491 through which wires can pass.

The second receiving portion 25 is substantially rectangular. The second receiving portion 25 defines a receiving hole 251 on the mounting wall 215 and a guide hole 253 in the wiring wall 213. The second receiving portion 25 forms a guide hook 254 at each corner, and an elastic limiting hook 255 positioned higher than the guide hook 254 from the bottom surface 210. The limiting hook 255 forms a limiting protrusion 2551 on a side surface of the limiting hook 255 and a positioning protrusion 2553 on the other side surface of the limiting hook 255 opposite to the limiting protrusion 2551 at an end away from the bottom surface 210. The second receiving portion 25 forms a pair of latching protrusions 2511 facing each other at a side surface of the receiving hole 251.

The top cover 23 includes a rectangular baseboard 231 and a shutter 233. The baseboard 231 defines a circular stepped hole 2311 corresponding to the fixing hole 2483 of the first receiving portion 24. The baseboard 231 forms an engaging portion 2313 with the wiring portion 249 of the first receiving portion 24 at an end. When the baseboard 231 covers the first receiving portion 24, the engaging portion 2313 and the wiring portion 249 cooperatively define a wiring port (not labeled) therebetween through which wires can pass. The shutter 233 is substantially rectangular, defining an L-shaped sliding jack 2330. The sliding jack 2330 includes a longitudinal sliding portion 2331 and a mounting portion 2332 corresponding to the limiting protrusion 2551 of the limiting hook 255 at an end of the sliding portion 2331. The sliding portion 2331 defines a first positioning jack 2333 at an end away from the mounting portion 2332 and a second positioning jack 2334 at the other end adjacent to the mounting portion 2332. The shutter 233 forms a pair of locking hooks 2335 corresponding to the pair of latching protrusions 2511 of the second receiving portion 25.

Figure 3:
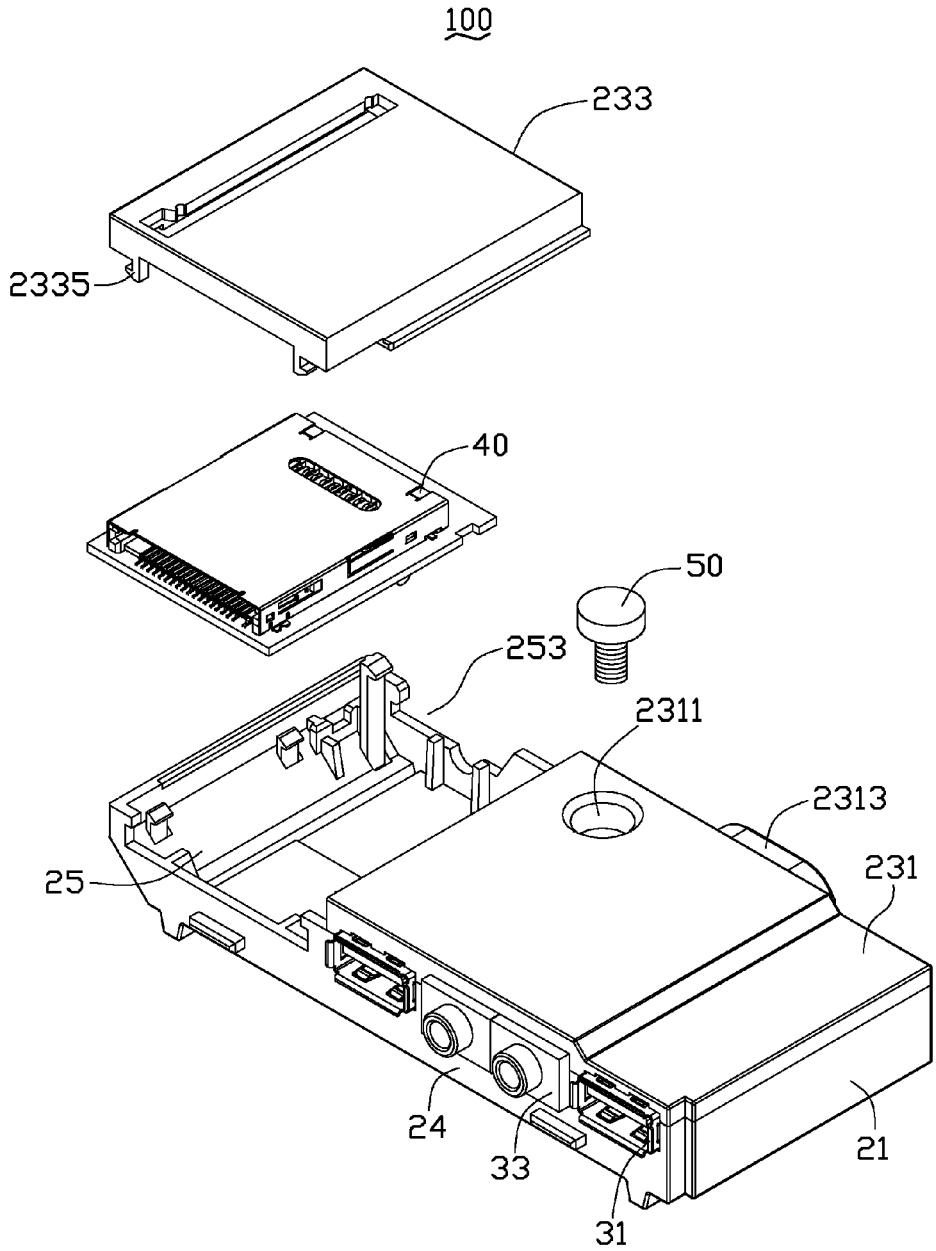
FIG. 3 is a partially exploded, isometric view of the connector assembly of FIG. 1.
Figure 4:
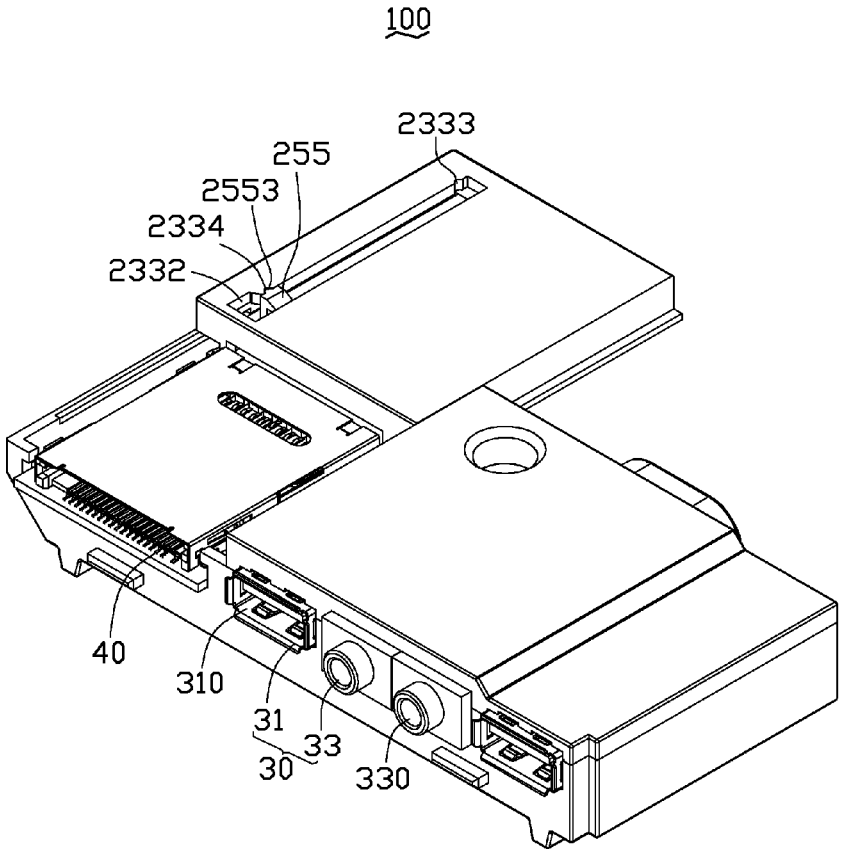
FIG. 4 is an isometric view of the connector assembly in an open state.

As shown in FIGS. 3 and 4, in assembly, the two audio jacks 33 are positioned in the audio notch 243, and the two USB jacks 31 are positioned in the USB notch 242. The stopping rib 331 of the audio jack 33 and the stopping strip of the USB jack 31 are blocked by the stopping boards 244 to prevent the USB jack 31 and the audio jack 33 from with-drawing from the first receiving portion 24. The wires pass through the wiring portion 249, then pass by the post 247, and finally fixed on the USB jack 31 and the audio jack 33 accordingly. The baseboard 231 is fixed on the first receiving portion 24 by ultrasonic sewing. A fastener 50 passes through the stepped hole 2311 and is received in the fixing hole 2483 of the fixing post 248 to firmly fix the baseboard 231 on the first receiving portion 24. The card reader 40 is mounted in the second receiving portion 25. The fixing hook 254 latches the edge of the circuit board 403 to fix the card reader 40. A wire (not shown) may pass through the guide hole 253 and connect to the card reader 40 to transmit the data to a computer (not shown). The limiting protrusion 2551 of the limiting hook 255 passes through the mounting portion 2332 and abuts a surface of the shutter 233 away from the locking hook 2335. The limiting hook 255 may be compressed and received in the sliding portion 2331. The limiting hook 255 is slidable in the sliding portion 2331, and the positioning protrusion 2553 may be latched in the first positioning notch 2333 to maintain the shutter 233 in an open position, and the card reader 40 can be detached from the second receiving portion 25. The positioning protrusion 2553 may also be latched in the second positioning notch 2334 and each locking hook 2335 latches with the latching protrusion 2511 accordingly, to maintain the shutter 233 in a closed position (FIG. 1).

If the card reader 40 is damaged, the shutter 233 may be moved to the open portion and the damaged card reader 40 can be removed without replacing the entire connector assembly 100, thereby decreasing usability costs.

It is understood that the shutter 233 may be hinged at a side of the second receiving portion 25, and open and shut on the second receiving portion 25, whereby the card reader 40 can also be replaced.

Finally, while particular embodiments have been described, the description is illustrative and is not to be construed as limiting. For example, various modifications can be made to the embodiments by those of ordinary skill in the art without departing from the true spirit and scope of the invention as defined by the appended claims.

What is claimed is:

1. A connector assembly comprising:

a connector;

a card reader; and a housing comprising a top cover and a bottom cover, the top cover comprising a first receiving portion for receiving the connector, a second receiving portion for receiving the card reader, a baseboard fixed on the first receiving portion, and a shutter moveably positioned on the second receiving portion for covering the card reader, wherein the shutter defines a sliding jack;

the second receiving portion comprises a limiting hook passing through the sliding jack and a limiting protrusion abutting the shutter, to prevent the shutter from separating from the second receiving portion.

2. The connector assembly of claim 1, wherein the sliding jack comprises a sliding portion, a side surface of which defines a first positioning notch, and the limiting hook comprises a positioning protrusion received in the first positioning notch, to maintain the shutter in a closed position.

3. The connector assembly of claim 2, wherein the side surface of the sliding portion further defines a second positioning notch spaced from the first positioning notch corresponding to the positioning protrusion to maintain the shutter in an open position.

4. The connector assembly of claim 3, wherein the sliding jack further comprises a mounting portion at an end adjacent to the second positioning jack through which the positioning protrusion passes.

5. The connector assembly of claim 1, wherein the second receiving portion further comprises a fixing hook latching with the card reader.

6. The connector assembly of claim 1, wherein the bottom cover comprises a mounting wall and a wiring wall opposite to the mounting wall; the second receiving portion defines a receiving hole at the mounting wall and defines a guide hole at the wiring wall through which wires can pass.

7. The connector assembly of claim 6, wherein the second receiving portion further comprises a pair of latching protrusions at a side surface of the receiving hole, and the shutter forms a pair of locking hooks latching with the latching protrusions.

8. The connector assembly of claim 1, wherein the first receiving portion forms a fixing post defining a fixing hole, the baseboard defines a through hole corresponding to the fixing hole, and the connector assembly further comprises a fastener passing through the through hole and received in the fixing hole.

9. The connector assembly of claim 1, further comprising a divider dividing the first receiving portion and the second receiving portion.

10. A connector assembly comprising:

a connector;

a card reader; and a housing comprising a top cover and a bottom cover, the top cover comprising a first receiving portion for receiving the connector, a second receiving portion for receiving the card reader, a baseboard fixed on the first receiving portion, and a shutter moveably positioned on the second receiving portion for covering the card reader, wherein the second receiving portion comprises a limiting hook comprising a positioning protrusion, the shutter defines a sliding jack a first positioning notch for receiving the position protrusion to close the second receiving portion, and a second positioning notch spaced from the first positioning notch, the limiting hook being slidable in the sliding jack, and the positioning protrusion being slidable into the second positioning notch to open the second receiving portion.

11. The connector assembly of claim 10, wherein the limiting hook further comprises a limiting protrusion abutting the shutter to prevent the shutter from separating from the second receiving portion.

12. The connector assembly of claim 11, wherein the sliding jack further comprises a mounting portion at an end adjacent to the second positioning notch through which the positioning protrusion passes.

13. The connector assembly of claim 10, wherein the second receiving portion further comprises a fixing hook latching with the card reader.

14. The connector assembly of claim 10, wherein the bottom cover comprises a mounting wall and a wiring wall opposite to the mounting wall, and the second receiving portion defines a receiving hole at the mounting wall and defines a guide hole at the wiring wall through which wires can pass.

15. The connector assembly of claim 14, wherein the second receiving portion further comprises a pair of latching protrusions at a side surface of the receiving hole, and the shutter comprises a pair of locking hooks latching with the latching protrusions.

16. The connector assembly of claim 10, wherein the first receiving portion comprises a fixing post defining a fixing hole, the baseboard defines a through hole corresponding to the fixing hole, and the connector assembly further comprises a fastener passing through the through hole and received in the fixing hole.

17. The connector assembly of claim 10, further comprising a divider dividing the first receiving portion and the second receiving portion.

* * * * *